US005267801A

United States Patent [19]

Huang

[11] Patent Number: 5,267,801

[45] Date of Patent: Dec. 7, 1993

[54] RIBBON INKER

[76] Inventor: Dennis Huang, 2F, No. 1, Lane 9, Ningpo E Street, Taipei, Taiwan

[21] Appl. No.: 998,452

[22] Filed: Dec. 30, 1992

[51] Int. Cl.[5] ..... B41J 31/14

[52] U.S. Cl. ..... 400/197; 400/200

[58] Field of Search ..... 400/197, 199, 218, 200, 400/202.1, 202.2, 202.3, 202.4

[56] References Cited

U.S. PATENT DOCUMENTS

| | | | |
|---|---|---|---|
| 2,695,092 | 11/1954 | Pelton | 400/202.4 |
| 4,990,007 | 2/1991 | Schmidt et al. | 400/218 |
| 5,035,522 | 7/1991 | Wright | 400/197 |
| 5,071,271 | 12/1991 | Chang et al. | 400/202.3 |

FOREIGN PATENT DOCUMENTS

| | | | |
|---|---|---|---|
| 3435082 | 4/1986 | Fed. Rep. of Germany | 400/202.3 |

*Primary Examiner*—Edgar S. Burr
*Assistant Examiner*—Anthony H. Nguyen
*Attorney, Agent, or Firm*—Bucknam and Archer

[57] ABSTRACT

A ribbon inker is disclosed including a transmission gear driven by a motor drive to rotate two spindles and a inking reel through a driven gear and a belt for permitting the ribbon of a ribbon cartridge to be moved by the inking reel over an inking pen, a reverse reel coupled to a reverse gear meshed with a gear on the inking reel for moving the ribbon of a ribbon cartridge in the reverse direction, two pitch adjusting devices and two elevation adjusting devices adjusted to hold down the ribbon cartridge to be inked according to its thickness and width.

3 Claims, 2 Drawing Sheets

RIBBON INKER

BACKGROUND OF THE INVENTION

The present invention relates to a ribbon inker for applying a printing ink to the ribbon of a ribbon cartridge, which can be adjusted to wind the ribbon in either direction.

In order to repeatedly use an ordinary ribbon cartridge, the ribbon must be regularly applied with a printing ink. Various devices have been proposed for applying a printing ink to the ribbon of a ribbon cartridge, and have appeared on the market, for example: the device disclosed in U.S. Pat. No. 5,071,271. Because these ribbon inking devices can only wind the ribbon in one direction, they are not suitable for all kinds of ribbon cartridges. Further, these ribbon inking devices do not provide such a ribbon cartridge hold-down means that can be adjusted according to the size of the ribbon cartridge to be inked.

SUMMARY OF THE INVENTION

The present invention has been accomplished under the aforesaid circumstances. According to one aspect of the present invention, the ribbon inker comprises a ribbon winding mechanism consisted of an inking wheel, two spindles and a belt, a speed reducing gear set driven by a motor drive to rotate the ribbon winding mechanism, and a reverse reel rotated by a gear on the inking reel through a reverse gear for winding the ribbon of a ribbon cartridge in the reverse direction. According to another aspect of the present invention, two pitch adjusting devices and two elevation adjusting devices are respectively fastened to the base of the ribbon inker at suitable locations and adjusted to hold down the ribbon cartridge to be inked according to its size.

DETAILED DESCRIPTION OF THE PREFERRED EMBODIMENT

Figure 1:
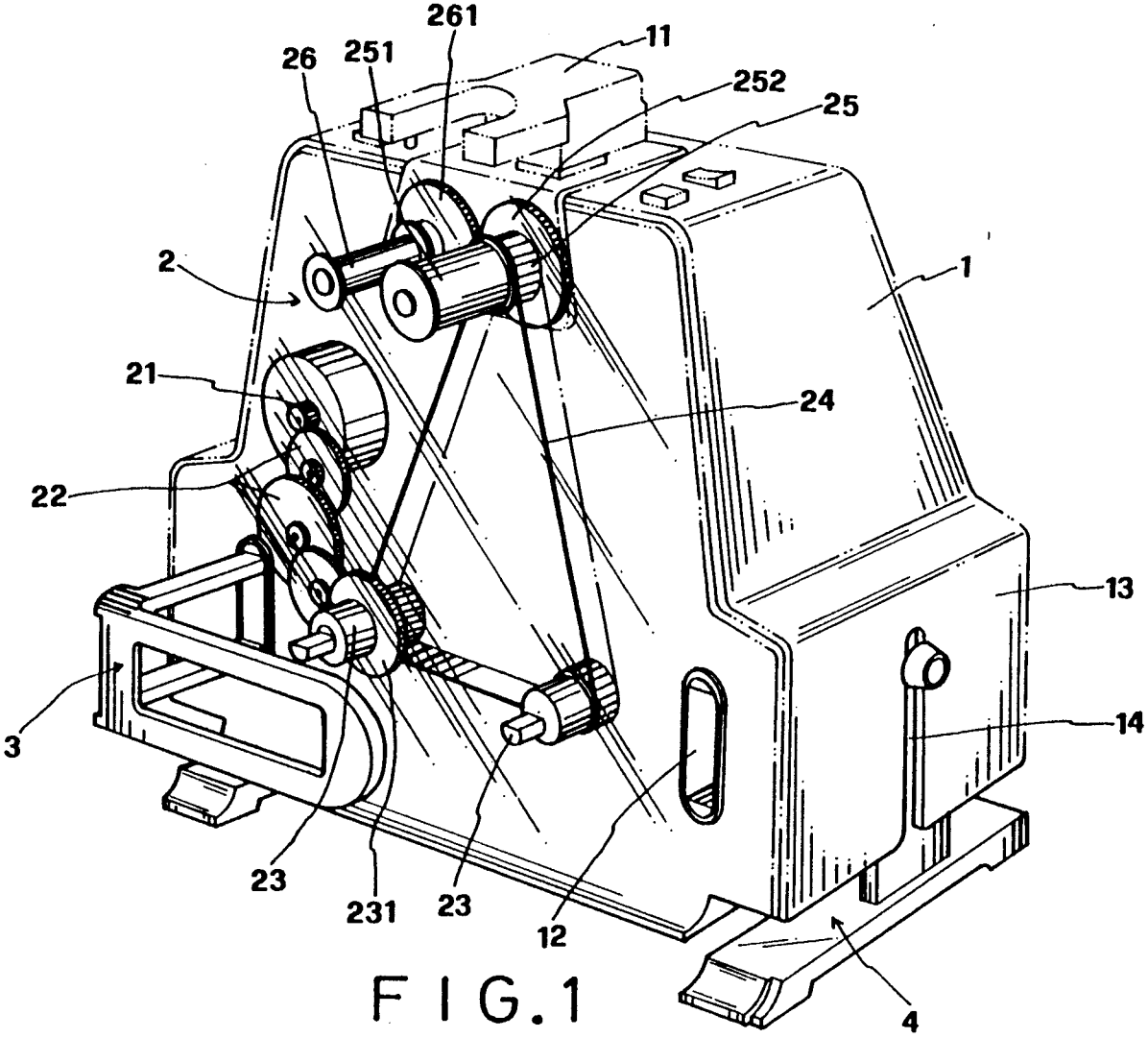
FIG. 1 is a perspective elevational view of a ribbon inker embodying the present invention.
Figure 2:
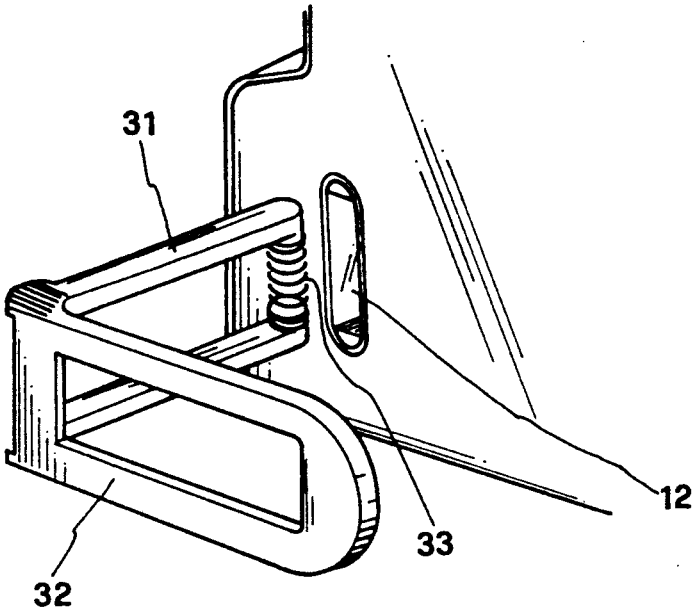
FIG. 2 is an enlarged elevational view of the pitch adjusting device of the ribbon inker.
Figure 3:
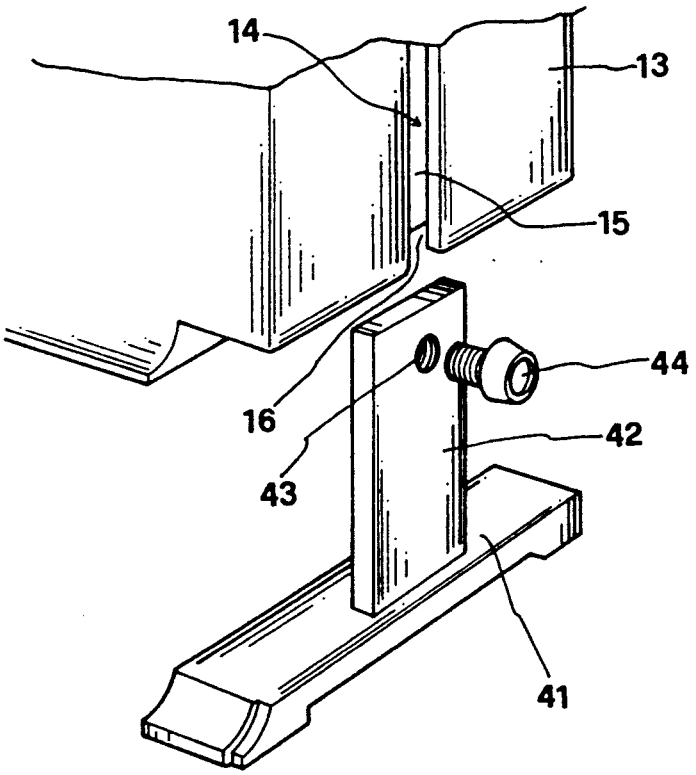
FIG. 3 is an enlarged elevational view of the elevation adjusting device of the ribbon inker.

Referring to the annexed drawings in detail, therein illustrated is a ribbon inker embodying the present invention, which is generally comprised of a base 1, a transmission mechanism 2, two adjusting devices 3, and two elevation adjusting devices 4.

The base 1 comprises a unshaped clamp 11 at the top for holding an inking pen, two elongated openings 12 spaced on the front face thereof at a lower level in vertical direction, which receive the pitch adjusting device 3, two elongated grooves 14 through two opposite outer side walls 13 thereof in vertical direction, two opposite inner side walls 15 respectively spaced from the outer side walls 13 by a respective chamber 16.

The transmission mechanism 2 is fastened inside the base 1, and consisted of an output gear 21 coupled to the output shaft of a motor (not shown), two spaced spindles 23 extended out of the front face of the base 1 and disposed at the same elevation, a driven gear 231 mounted on one of the spindles 23, a speed reducing gear set 22 meshed between the output gear 21 and the driven gear 231, an inking reel 25 spaced above the spindles 23 at the middle and having one end extended out of front face of the base 1 and covered with a sleeve 251 and an opposite end coupled with an inking gear 252 inside the base 1, a belt 24 mounted around the spindles 23 and the inking reel 25 and disposed inside the base 1, a reverse gear 261 meshed with the inking gear 252, and a reverse reel coupled to the gear axle (not shown) of the reverse gear 261. Therefore, rotating the drive gear 21 causes the speed reducing gear set 22 to rotate the spindles 23 and the inking reel 25 via the driven gear 231 and the belt 24, and at the same time the reverse reel 26 is rotated by the inking gear 252 via the reverse gear 261. The arrangement of the sleeve 251 on the inking reel 25 is to keep the ribbon to be in contact with the inking pen.

The pitch adjusting devices 3 are identical, each consisted of an angle frame, which comprises two parallel legs 31 extended from a ribbon cartridge hold-down frame 32 at right angles, and a spring 33 connected between the parallel legs 31. By squeezing the legs 31 toward each other in compressing the spring 33, the pitch adjusting device 3 can be inserted in either opening 12 on the front face of the base 1. After the legs 31 have been inserted in either opening 12 and released from the hand, the legs 31 are immediately stretched outwards from each other by the spring 33 and retained in the opening 12.

The elevation adjusting devices 4 are identical, each comprising a stand 41, a flat support 42 raised from the stand 41 and inserted in either chamber 16 on the base 1. The flat support 42 has a screw hole 43 near its top, into which a tightening up screw 44 is threaded through either elongated groove 14 to hold down the flat support 42 against the corresponding inner side wall 15.

During the operation of the ribbon inker, the ribbon cartridge to be inked is mounted on the spindles 23 and retained in position by the pitch adjusting devices 3, and the ribbon of the ribbon cartridge is wound round the sleeve 251 on the inking reel 25. As the motor is started, the ribbon is moved over the sleeve 251 against the inking pen, and therefore a printing ink is being uniformly and continuously applied to the ribbon. For inking the ribbon of a ribbon cartridge having a reversed winding direction, the sleeve 251 is removed from the inking reel 25 and then mounted on the reverse reel 26, and therefore the ribbon of the ribbon cartridge can be moved by the reverse reel 26 and the sleeve 251 in the reverse direction.

Further, the pitch adjusting devices 3 and the elevation adjusting devices 4 can be conveniently adjusted according to the thickness and width of the ribbon cartridge to be inked.

The embodiment described is simple in structure and therefore functional. It is to be understood that various modifications and changes could be made without departing from the scope of the invention and the invention is not to be considered limited to what is shown in the drawings and described in the specification.

What is claimed is:

1. A ribbon inker comprising a base having a clamp on the top thereof and an inking pen fastened to said top of said base by said clamp for applying a printing ink to the ribbon of a ribbon cartridge, said base having a front face, two spindles and an inking reel arranged on said front face of said base so as to form a triangle, a motor drive and a belt connected to rotate said spindles to drive the ribbon of a ribbon cartridge over said inking pen, two pitch adjusting devices and two elevation adjusting devices fastened to said base and adjustable to hold the ribbon cartridge to be inked in position, said motor drive being fastened inside said base and comprising an output gear, a drive gear and a speed reducing gear set, for permitting said inking reel to be rotated by said spindles via said belt; a gear, a reverse gear and a reverse reel, said reverse gear being coupled with said reverse reel and meshing with said gear, said reverse reel being rotated to wind the ribbons of said ribbon cartridge in the reverse direction as said inking reel is rotated.

2. The ribbon inker of claim 1 wherein said ribbon cartridge has a hold-down side, said base has two openings on said front face and each pitch adjusting device comprises a frame having two parallel legs extending at a right angle to said ribbon cartridge hold-down side, a spring which joins said legs for inserting and retaining said legs in one of said openings whereby when the spring is compressed, said legs are released from the opening as they are squeezed toward each other or are firmly retained in said opening as they are released from pressure.

3. The ribbon inker of claim 1 wherein a pair of stands supports said base, said base includes a a pair of bottom chambers adjacent each of said elevation adjusting devices and opposite side walls each having a groove therein, each elevation adjusting device comprises a flat support raised from each of said stands and inserted in one of said bottom chambers on said base, a tightening screw is threaded through each of said flat supports having a screw hole near the top thereof, said tightening screw being threaded through a respective one of said grooves to firmly hold said flat support onto said base.

* * * * *